US005593553A

United States Patent [19]

Woolhouse et al.

[11] Patent Number: 5,593,553

[45] Date of Patent: Jan. 14, 1997

[54] ELECTROLYTIC CELL AND ELECTRODE THEREFOR

[75] Inventors: Robin A. Woolhouse, Nantwich; Brian K. Revill, Runcorn, both of United Kingdom

[73] Assignee: Imperial Chemical Industries PLC

[21] Appl. No.: 436,263

[22] PCT Filed: Oct. 28, 1993

[86] PCT No.: PCT/GB93/02221

§ 371 Date: May 16, 1995

§ 102(e) Date: May 16, 1995

[87] PCT Pub. No.: WO94/12692

PCT Pub. Date: Jun. 9, 1994

[30] Foreign Application Priority Data

Nov. 20, 1992 [GB] United Kingdom ..... 9224372

[51] Int. Cl.[6] ..... C25B 9/00

[52] U.S. Cl. ..... 204/252; 204/280; 204/284; 204/290 R; 205/526; 205/532

[58] Field of Search ..... 204/280, 290 R, 204/252, 284; 205/526, 532

[56] References Cited

U.S. PATENT DOCUMENTS

| | | | |
|---|---|---|---|
| 4,108,742 | 8/1978 | Seko et al. | 204/98 |
| 4,138,295 | 2/1979 | deNora et al. | 204/98 |
| 4,592,822 | 6/1986 | deNora | 204/284 |
| 5,013,418 | 5/1991 | Wüllenweber et al. | 204/284 |
| 5,130,008 | 7/1992 | Cabaraux et al. | 204/283 |

FOREIGN PATENT DOCUMENTS

| | | |
|---|---|---|
| 0111149 | 6/1984 | European Pat. Off. . |
| 0383243 | 8/1990 | European Pat. Off. . |
| 0412600A1 | 2/1991 | European Pat. Off. . |
| 2263034 | 10/1975 | France . |

*Primary Examiner*—Bruce F. Bell

[57] ABSTRACT

An electrode comprising a first plate (4) having an active electrode surface and a second plate (14) facing and spaced from the first plate, and at least one barrier plate (13) positioned between the first and second plates and spaced from the active electrode surface of the first plate and from the facing surface of the second plate. An electrolytic cell comprising such an electrode and the use thereof in the electrolysis of aqueous alkali metal chlorides.

14 Claims, 3 Drawing Sheets

ELECTROLYTIC CELL AND ELECTRODE THEREFOR

BACKGROUND OF THE INVENTION

This invention relates to an electrolytic cell and to an electrode therefor and, in particular, to an electrolytic cell which is provided with liquor recirculating means.

Electrolytes, for example, aqueous solutions of alkali metal chlorides, particularly sodium chloride, are electrolyzed on a vast scale throughout the world in order to produce products such as chlorine and aqueous alkali metal hydroxide solution. The electrolysis may be effected in an electrolytic cell comprising a plurality of anodes and cathodes with each anode being separated from the adjacent cathode by a separator which divides the electrolytic cell into a plurality of anode and cathode compartments.

The electrolytic cell, may be of the diaphragm or membrane type. In the diaphragm type cell, separators positioned between adjacent anodes and cathodes are microporous and in use aqueous electrolyte passes through the diaphragms from the anode compartments to the cathode compartments of the cell. In the membrane type cell, the separators are essentially hydraulically impermeable, and in use, ionic species are transported across the membranes between the anode compartments and the cathode compartments of the cell.

For example, where aqueous alkali metal chloride solution is electrolyzed in an electrolytic cell of the diaphragm type the solution is charged to the anode compartments of the cell, chlorine which is produced during the electrolysis is removed from the anode compartments of the cell; the alkali metal chloride solution passes through the diaphragms, and hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alkali metal chloride solution is electrolyzed in an electrolytic cell of the membrane type, the solution is charged to the anode compartments of the cell and chlorine produced during the electrolysis and depleted alkali metal chloride solution are removed from the anode compartments; alkali metal ions are transported across the membranes to the cathode compartments of the cell to which water or dilute alkali metal hydroxide solution may be charged; and hydrogen and alkali metal hydroxide solution produced by reaction of alkali metal ions with water are removed from the cathode compartments of the cell.

The electrolysis may be effected in an electrolytic cell of the filter press type which may comprise a large number of alternating anodes and cathodes, for example, fifty anodes alternating with fifty cathodes, although the cell may comprise even more anodes and cathodes, for example up to one hundred and fifty alternating anodes and cathodes.

The electrolytic cell may be provided with an inlet header through which electrolyte, for example aqueous alkali metal chloride solution, may be charged to the anode compartment of the cell, and with an outlet header through which products of electrolysis may be removed therefrom. Also, the electrolytic cell may be provided with an outlet header through which products of electrolysis may be removed from the cathode compartments of the cell, and optionally, e.g. in the case of a membrane type cell, with an inlet header through which liquor, for example water or other fluid, may be charged thereto.

Electrolytic cells may be fitted with means for recirculating the liquors to the anode and/or cathode compartments of the cell. For example, in an electrolytic cell of the membrane type in which aqueous alkali metal chloride solution is electrolyzed and in which the solution is charged to the anode compartments of the cell through an inlet header and chlorine and depleted aqueous alkali metal chloride solution are removed therefrom through an outlet header, the electrolytic cell may be equipped with means for removing depleted aqueous alkali metal chloride solution from the anode compartments and recirculating the depleted solution, or a part thereof, back to the anode compartments of the cell for re-use therein. Prior to effecting the recirculation, the gaseous chlorine may be separated from the depleted alkali metal chloride solution, and the depleted solution may be mixed with alkali metal chloride or with fresh more concentrated aqueous alkali metal chloride solution prior to recirculation of the solution to the anode compartments.

Recirculation of the aqueous alkali metal chloride solution enables the solution to be re-used, and it ensures that a high conversion of alkali metal chloride may be effected without the conversion of alkali metal chloride may be effected without the conversion in a single pass through the anode compartments being so high that unacceptable concentration gradients result in the solution within the anode compartments of the cell, and between the solutions in different anode compartments of the cell, with consequent loss in current efficiency. Furthermore, as the solution removed from the cell is at a high temperature, the fresh solution may be at relatively low temperature. Indeed, it may be unnecessary to heat the fresh solution.

The electrolytic cell may be equipped with similar means by which aqueous alkali metal chloride solution may be removed from the cathode compartments, and the solution, or a part thereof, recirculated back to the cathode compartments.

The electrolytic cell may be provided with a recirculating means in which the solutions are recirculated within the anode or cathode compartments of the cell, rather than being removed from the compartments and recirculated back to the compartments. Such internal recirculating means are particularly useful in assisting in the elimination of concentration gradients within the solutions in the anode or cathode compartments of the cell which in turn results in an improvement in the current efficiency at which the electrolysis is effected.

Removal of solution from the anode or cathode compartments and recirculation back to the compartments may be effected by means of suitable pipework positioned externally of the electrolytic cell. For example, the outlet header from the anode or cathode compartments of the cell may be connected to a branched outlet pipe and part of the depleted solution removed from the compartments may be passed through the branched pipe to an inlet pipe, which is in turn connected to the inlet header of the anode or cathode compartments of the cell, and through which fresh solution may also be charged to the compartments of the cell. Part of the solution removed from the anode or cathode compartments of the electrolytic cell may be removed from the cell through the branched pipe.

An electrolytic ell having pipework positioned externally of the cell and through which solutions may be recirculated is described in U.S. Pat. No. 3,856,651. The recirculation system relies for its effectiveness on the gas-lift effect, and in the patent, there is described a bipolar cell having a tank positioned on top of the cell to which chlorine-containing aqueous sodium chloride solution is passed from the anode compartments of the cell. Chlorine is separated from the solution in the tank, and the solution is removed from the tank and mixed with fresh, more concentrated sodium chloride solution and returned to the anode compartments of the cell via an externally positioned pipe.

Recirculation of the solution may also be effected within the anode or cathode compartments of an electrolytic cell. Such recirculation may be effected by means of downcomers positioned in the compartments of the cell, for example, by means of a downcomer positioned between a pair of electrode plates in an electrode compartment of a cell. Such recirculation also relies for its effectiveness of the gas-life effect.

An electrolytic cell in which there is internal recirculation is described in U.S. Pat. No. 4,557,816. In the patent, there is described a duct which facilitates downward flow of electrolyte and which is positioned in a space to the rear of an electrode; the duct comprising a horizontal portion having a lower opening near the inlet for fresh electrolyte and a vertical portion in communication with the horizontal portion and having an upper opening near the outlet for the depleted electrolyte.

SUMMARY OF THE INVENTION

The present invention is concerned with recirculation of the solution within the anode or cathode compartments of an electrolytic cell in order that the elimination of concentration gradients within the solution may be assisted and in order that electrolysis may be effected at increased current efficiency. The invention is, in particular, concerned with recirculating means which are of very simple construction, which are readily installed in the electrolytic cell, and which are particularly suitable for use in an electrolytic cell of the filter press type in which the anode and cathode compartments are generally narrow, and in which it is difficult, or at the very least inconvenient, to install a recirculating means which comprises ducts or pipework. The invention affords the further advantage that a cell comprising the electrode may be operated with acidified brine.

According to the present invention, there is provided an electrode comprising a first plate having an active electrode surface and a second plate facing and spaced from said first plate, and at least one barrier plate positioned between said first and second plates and spaced from the active electrode surface of said first plate and from the facing surface of said second plate.

The invention also provides an electrolytic cell which comprises at least one anode and at least one cathode and a separator positioned between each anode and adjacent cathode thereby dividing the cell into separate anode and cathode compartments, or into a plurality of such compartments, and in which the anode or cathode or both comprises an electrode of the present invention. The separator may be a hydraulically impermeable ion-exchange membrane or a hydraulically permeable diaphragm.

The electrode of the present invention when installed in an electrolytic cell achieves recirculation of solution within the electrode compartment of the cell by means of the gas lift effect. Thus, when gas is evolved at the active electrode surface of the first plate, the gas rises in the space between the first plate and the barrier plate to the top of the electrode compartment, carrying solution with it. The solution then descends through the space between the barrier plate and the second plate to the bottom of the electrode compartment and thereafter is caused to rise again by the gas lift effect of the gas evolved at the active electrode surface.

DETAILED DESCRIPTION OF THE INVENTION

The electrode of the present invention is of simple construction, indeed an existing electrode may be modified merely by inserting into the electrode one or more barrier plates, which may be relatively thin, and it is particularly suitable for use with electrodes in a filter press type electrolytic cell in which the electrodes, and the electrode compartments may be relatively narrow. The recirculation means clearly does not rely on the use of pipes or ducts within the electrode.

The barrier plate may contact a first plate having an active electrode surface provided the barrier plate is spaced from at least part of the active electrode surface of the first plate; this space providing a space through which gas and associated liquid may rise in an operating electrolytic cell.

Thus, the first plate may have an active electrode surface on one face and the barrier plate may be in contact with an opposite face of the first plate; the latter face not having an active electrode surface.

The electrode may comprise a first plate having an active electrode surface and a second plate which is electrically connected to the fist plate but which does not have an active electrode surface. In this embodiment, a single barrier plate may be positioned between the first and second plates and be spaced from the active electrode surface of the first plate and the facing surface of the second plate.

Alternatively, the electrode may comprise two plates electrically connected to and spaced from each other and each having an active electrode surface. The active electrode surfaces are suitably outwardly facing. In this embodiment, two barrier plates may be positioned between the plates having active electrode surfaces and be spaced from the said surfaces, and the barrier plates may also be spaced from each other. When this latter electrode is installed in an electrolytic cell, gas evolved at the active electrode surfaces rises and carries solution with it to the top of the electrode compartment, and the solution then descends through the space between the two barrier plates to the bottom of the electrode compartment, from where it is caused to rise once again.

In the electrode, the various plates are spaced from each other. Any suitable spacing means may be used to achieve the necessary spacing of the various plates. For example, suitably shaped spacers may be positioned between the various plates. In the embodiment of the electrode hereinbefore described which comprises two barrier plates spaced apart from each other, spacing may be achieved by means of spaced apart projections on one plate, or on both plates, which contact a face of the other plate. The projections may not only contact a facing plate but may be sealed to the facing plate by any convenient means, which will depend on the nature of the material from which the plates are constructed.

The various plates in the electrode, that is the first and second plates, and the barrier plate or plates will generally be substantially parallel to each other, and they will generally be substantially planar or at least lie in a plane.

In order that the desired recirculation of solution may take place when the electrode is installed in an operating electrolytic cell, the barrier plate or plates must be so positioned in the electrode that in the electrode a space is provided above the top of the barrier plate and below the bottom of the barrier plate through which the solution may pass during recirculation of the solution. The barrier plate or plates may, for example, have a height which is at least 50%, or even at least 90% of the height of the electrode, or at least of that part of the electrode within which the barrier plate is positioned.

The barrier plate may extend substantially completely across the electrode although this is not necessarily so. For example, the barrier plate may have a length which is at least 10% of that of the first plate having an active electrode surface, preferably at least 50%. The thickness of the barrier plate may vary, and it will depend on the distance between the first and second plates of the electrode. By way of example, the barrier plate may have a thickness which is at least 10% of the distance between the first and second plates of the electrode. In the embodiment of the electrode which comprises two plates electrically connected to and spaced from each other and each having an active electrode surface, and two barrier plates positioned between those plate having active electrode surfaces, the thickness of the barrier plate in total may, for example, be at least 10% of the distance between the plates having active electrode surfaces.

The barrier plate may be of substantially solid construction so that it prevents flow of solution transversely across the electrode. However, it may be so constructed that some transverse flow of solution is possible.

The material of construction of the barrier plate will depend on the solution which is to be electrolyzed in the cell. The barrier plate should of course be resistant to chemical attack by the solution to be electrolyzed and by the products of electrolysis. The barrier plate may be a metallic material or it may be an organic plastics material. For example, where the electrode is to be installed in an electrolytic cell in which aqueous alkali metal chloride solution is to be electrolyzed to produce chlorine and aqueous alkali metal hydroxide solution, a barrier plate made of a fluorine-containing organic polymeric material, e.g. polytetrafluoroethylene, tetrafluoroethylenehexafluoropropylene copolymer, or fluorinated ethylenepropylene copolymer may suitably be used. Other suitable materials of construction may readily be selected when the nature of the solution which is to be electrolyzed is known. For example, the barrier plate may be made of a film-forming metal or alloy, e.g. titanium or an alloy thereof, and it may have a coating of an electrocatalytically-active material, e.g. a platinum group metal or an oxide thereof.

The electrode itself, that is the electrode in the absence of the barrier plate, have a variety of different constructions. For example, the first plate having an active electrode surface may be in the form of a mesh, which may be woven or unwoven, or it may be in the form of a plurality of elongated members, e.g. strips, which are spaced apart from each other and lie in a plane and which are generally parallel to each other. The elongated members may be attached to their ends to a support member, e.g. a support member in the form of a frame.

The first plate or plates of the electrode may be dished; that is, they may lie in a plane substantially parallel to but displaced from the plane of a support member.

The nature of the material of construction of the electrode will depend on whether it is to be used as an anode or as a cathode and on the nature of the solution which is to be electrolyzed. For example, where the solution which is to be electrolyzed is an aqueous alkali metal chloride solution a suitable material for use as an anode is a film-forming metal or alloy, e.g. titanium, tantalum, zirconium, niobium or hafnium. A suitable material for use as a cathode is steel or nickel.

The active electrode surface of the electrode may be provided by a suitable electrocatalytically-active coating on at least part of the surface of the first plate.

Suitable electrocatalytically active coatings which may be applied to the surfaces of the anodes and/or cathodes include, in the case of anodes, an oxide of a platinum group metal preferably in admixture with an oxide of a film-forming metal, particularly a mixture in the form of a solid solution, and in the case of cathodes, a platinum group metal. Such coatings, and methods of application, are well-known in the art and do not need to be described further.

The electrolytic cell may be monopolar cell or a bipolar cell. In a monopolar cell, a separator may be positioned between each anode and adjacent cathode. The electrolytic cell may be a bipolar cell comprising a plurality of electrodes having an anode face and a cathode face. In a bipolar cell, a separator may be positioned between an anode face of an electrode and a cathode face of an adjacent electrode.

The electrolytic cell may comprise an inlet header through which solution may be charged to the anode compartment(s) of the electrolytic cell, and an outlet header through which products of electrolysis may be removed from the anode compartment(s) of the electrolytic cell, and an inlet header through which solution may be charged to the cathode compartment(s) of the electrolytic cell, and an outlet header through which products of electrolysis may be removed from the cathode compartment(s) of the electrolytic cell.

The headers may be provided by openings in the electrode plates, e.g. in a frame-like part thereof, which together with similarly positioned openings in the gaskets of the electrolytic cell form lengthwise compartments which serve as headers, ad described for example in European patent 80287.

The electrolytic cell is preferably of the filter press type, and a preferred form of electrolytic cell of this type comprises a plurality of anodes and cathodes and gaskets of an electrically non-conducting material.

Where the separator in the electrolytic cell is a hydraulically permeable diaphragm, it may be made of a porous organic polymeric material. Preferred organic polymeric materials are fluorine-containing polymers on account of the generally stable nature of such materials in the corrosive environment encountered, for example, in chlor-alkali electrolytic cells. Suitable fluorine-containing polymeric materials include, for example, polychloro-trifluoroethylene, fluorinated ethylene-propylene copolymer, and polyhexafluoropropylene. A preferred fluorine-containing polymeric material is polytetra-fluoroethylene on account of its great stability in corrosive chlor-alkali electrolytic cell environments.

Such hydraulically permeable diaphragm materials are known in the art.

Preferred separators for use as ion-exchange membranes which are capable of transferring ionic species between the anode and cathode compartments of an electrolytic cell are those which are cation perm-selective. Such ion exchange materials are known in the art and may be fluorine-containing polymeric materials, preferably perfluoropolymeric materials, containing anionic groups, e.g. carboxylic, sulphonic or phosphoric groups.

BRIEF DESCRIPTION OF THE DRAWINGS

The invention is further illustrated by reference to the accompanying drawings which illustrate, by way of example only, certain aspects of the present invention. In the drawings.

DESCRIPTION OF THE PREFERRED EMBODIMENTS

Figure 1:
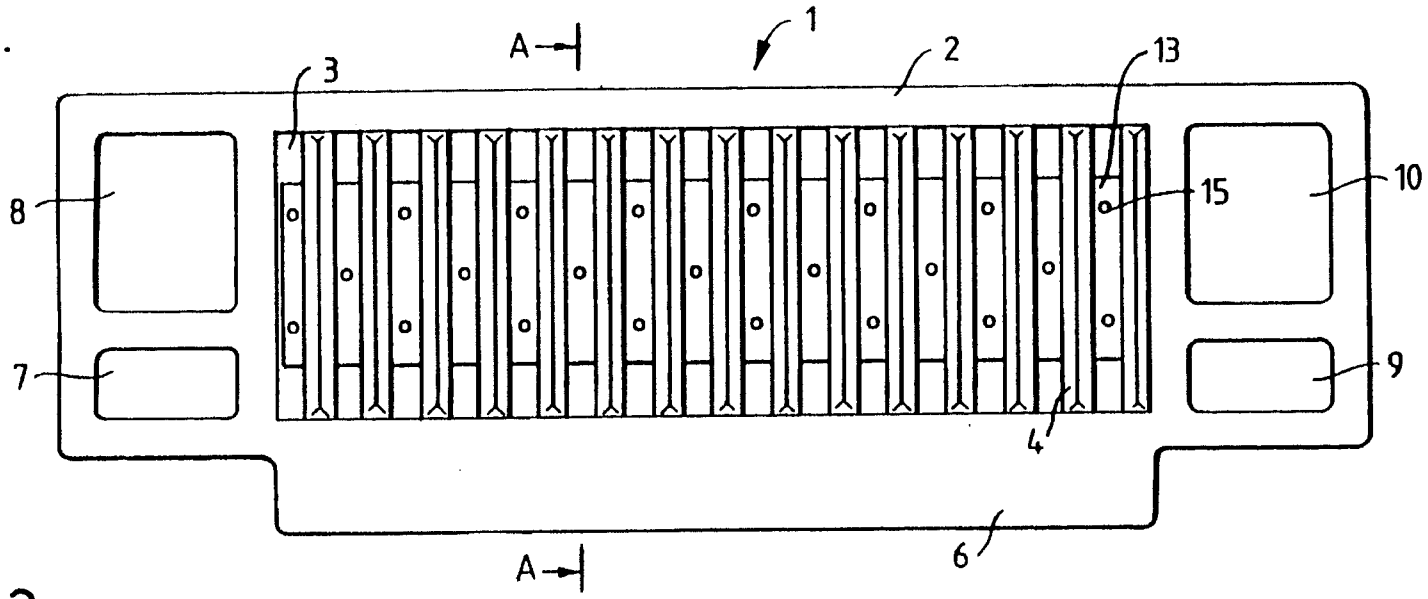
FIG. 1 is a view in elevation of an electrode of the invention.
Figure 2:
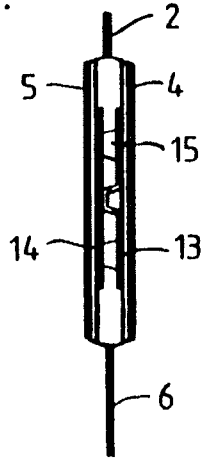
FIG. 2 is an end view on a reduced scale and in cross-section along the line A—A of FIG. 1.
Figure 3:
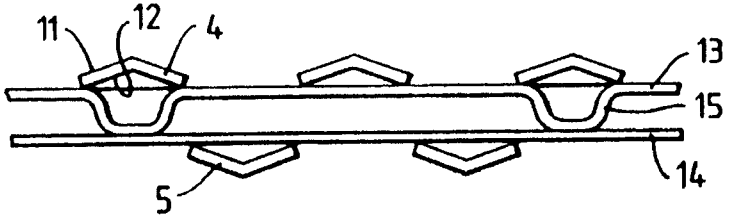
FIG. 3 is a plan view of a part of an electrode of the invention.

Referring to FIGS. 1 to 3, the electrode 1 comprises a frame part 2 which defines a central opening 3 which is bridged by a plurality of vertically disposed blades 4 which are attached to the upper and lower parts of the frame 2 and are parallel to and displaced from the plane of the frame 2. The blades are positioned on both sides of the frame 2. The blades are so positioned that a blade 4 on one side of the frame 2 is positioned opposite the gap between two adjacent blades 5 on the other side of the frame 2.

The electrode 1 has a projection 6 onto which a suitable electrical connection may be fixed. Where the electrode 1 is to be used as an anode, the projection 6 is typically positioned on the lower edge of the frame 2, and where the electrode 1 is to be used as a cathode, the projection 6 is typically positioned on the opposite upper edge of the frame 2. The frame 2 comprises a pair of openings 7, 8 positioned to one side of the central opening 3 and a pair of openings 9, 10 positioned to the opposite side of the central opening 3. When the electrode is installed in an electrolytic cell, these openings form a part of compartments lengthwise of the cell through which solutions, e.g. electrolyte, may be charged to the anode and cathode compartments of the cell and through which the products of electrolysis may be removed from the anode and cathode compartments of the cell. The metal of the electrode will be chosen depending on whether it is to be used as an anode or a cathode and on the nature of the electrolyte to be used in the electrolytic cell. In the case of the electrolysis of aqueous alkali-metal chloride solution, the electrode when used as an anode, is suitably made of titanium, and, when used as a cathode, it is suitably made of nickel.

The blades 4 and 5 of the electrode, typically have a convex face 11 and a concave face 12, and when used as an anode, the convex face 11 of the blades suitably carries a coating of an electrocatalytically-active material.

The electrode 1 also comprises two barrier plate 13, 14 positioned in the central opening 3 of the electrode and between the blades 4, 5 of the electrode. The plates 13, 14 are parallel to each other, and they are spaced apart from each other by means of projections 15 on one plate 13 which contact and are bonded to the face of the other plate 14. The plates 13, 14 extend over substantially the whole width of the central opening 3 of the electrode 1. However, the plates 13, 14 are so positioned that there is a space between the top of the plates and the upper part of the frame 2 and also a space between the bottom of the plates and the lower part of the frame 2. The plates 13, 14 are in contact with the rear, concave, sides of the blades 4, 5 respectively; the plates thus being spaced from the active electrode (convex) surface of the blades of the electrode.

In the embodiment shown in FIGS. 1 to 3, the blades 4 constitute together a first plate of the electrode of the invention, plate 14 constitutes a second plate, and plate 13 constitutes a barrier plate spaced from the active electrode of the first plate and from the facing surface of the second plate. Alternatively, the blades 5 constitute together a first plate of the electrode of the invention, plate 13 constitutes a second plate, and plate 14 constitutes a barrier plate spaced from the active electrode surface of the first plate and from the facing surface of the second plate.

In a particular example, the plates 13 and 14 were made of fluorinated ethylene-propylene copolymer where the electrode was to be used in a cell for the electrolysis of aqueous alkali metal chloride solution.

Figure 4:
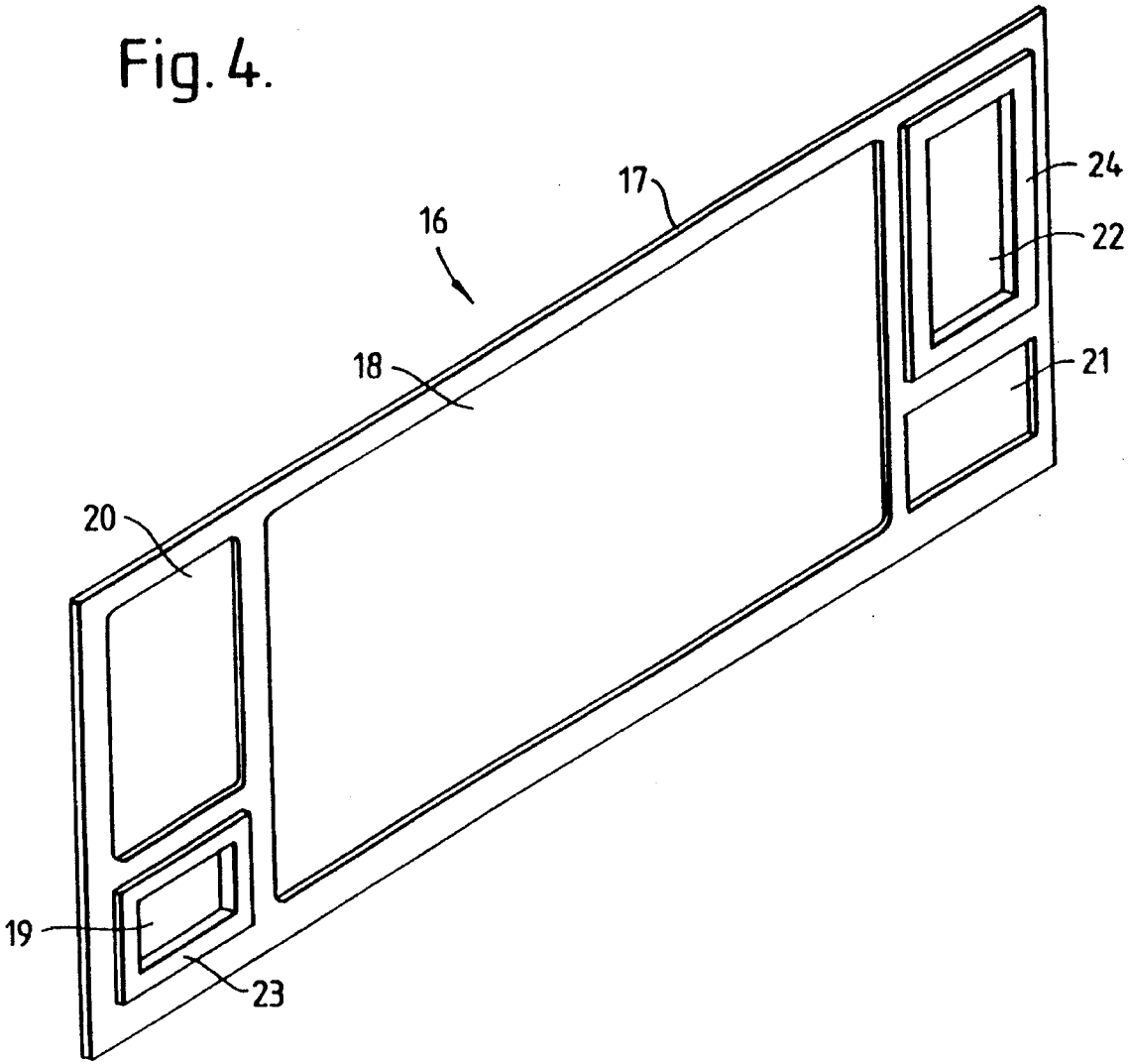
FIG. 4 shows an isometric view of a gasket for use in an electrolytic cell which incorporates the electrode of the invention.

Referring to FIG. 4, the gasket (16) comprises a frame (17) which defines a central opening (18). The frame (17) comprises a pair of openings (19, 20) positioned to one side of the central opening (18) and a pair of openings (21, 22) positioned to the opposite side of the central opening (18). When the gasket is installed in an electrolytic cell, these openings form a part of compartments lengthwise of the cell through which solutions, e.g. electrolyte, may be charged to the anode and cathode compartments of the cell and through which the products of electrolysis may be removed from the anode and cathode compartments of the cell. The openings (19, 22) also have upstanding frame members (23, 24) positioned around the openings and projecting from the plane of the gasket and which are adapted to fit into the openings (7, 10), respectively, of the metallic electrode when assembled into the electrolytic cell. The upstanding frame members (23, 24) provide the required electrical insulation in the electrolytic cell between the compartments lengthwise of the cell formed in part by openings (7, 8, 9, 10) in the electrode. The upstanding frame members (23, 24) are of unitary construction with the gasket (16) and may be produced, for example, by molding a suitable electrically insulating thermoplastic polymeric material. Where the electrolytic cell comprises gaskets of the type illustrated in FIG. 4, it will also comprise similar gaskets in which the upstanding frame members (23, 24) are positioned around the openings (21, 20) of the gasket.

Figure 5:
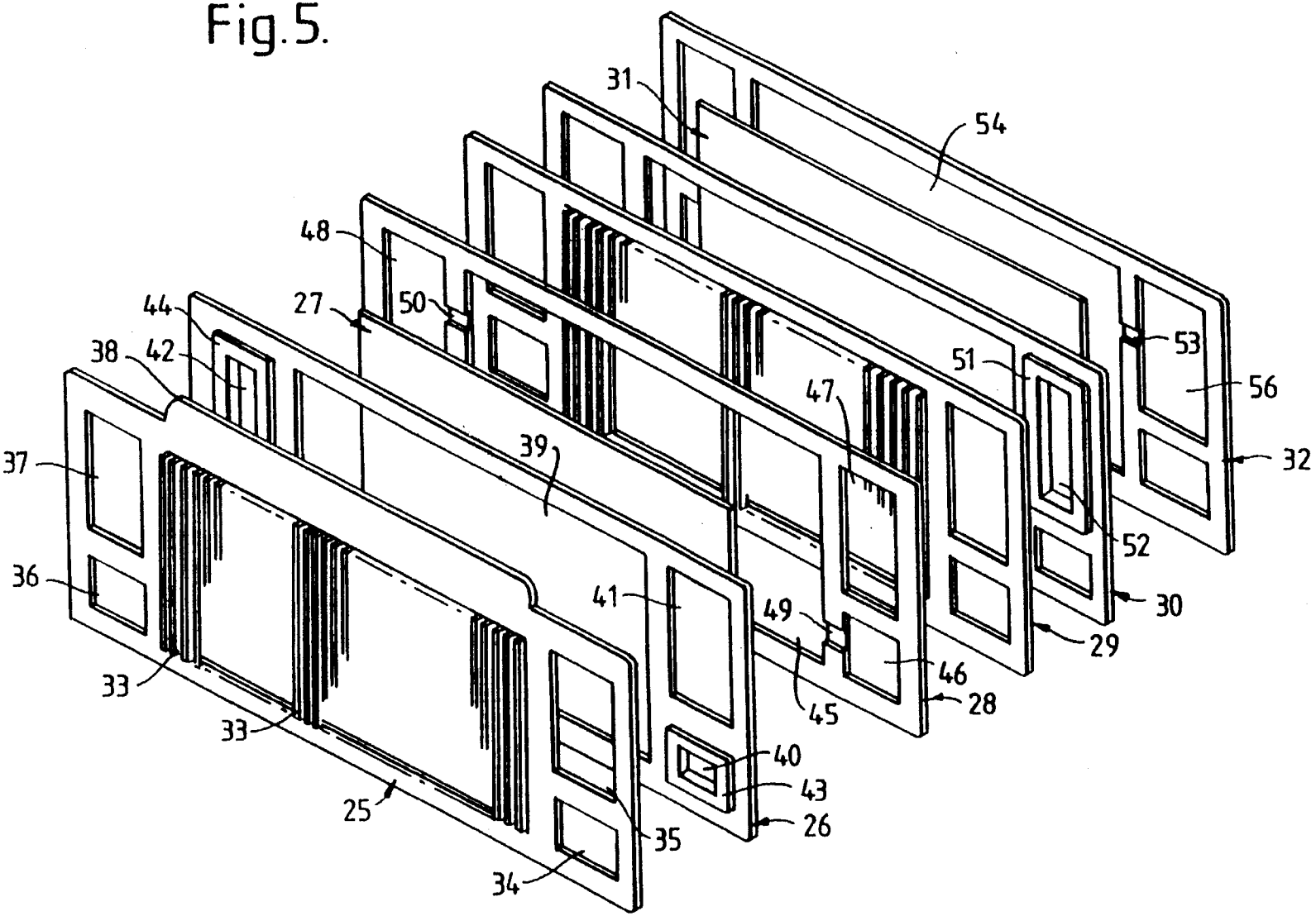
FIG. 5 shows an exploded isometric view of a part of an electrolytic cell. In this view, and for simplicity, the barrier plates are not shown in position in the electrode.

FIG. 5 shows a part of an electrolytic cell of the invention and comprises a cathode (25), a gasket (26), a cation-exchange membrane (27), a gasket (28), an anode (29) a gasket (30), a cation-exchange membrane (31), and a gasket (32). The cathode (25) comprises a plurality of vertically disposed blades (33) positioned on both sides of the cathode and four openings (34, 35, 36, 37) and a projection (38) suitable for electrical connection. (For simplicity, the barrier plates have been omitted from the electrode). The gasket (26) comprises a central opening (39) and four openings (40, 41, 42 one not shown) and two upstanding frame members (43, 44) projecting from the plane of the surface of the gasket. The gasket (28) is a plane gasket and comprises a central opening (45), four openings (46, 47, 48, one not shown), and also two channels (49, 50) in the walls of the gasket which provide communicating channels between the central opening (45) and the openings (46, 48), respectively). The anode (29) is of similar construction to the cathode (25) except that the projection for electrical connection is positioned on the lower edge of the anode and is not shown. The gasket (30) is of similar construction to the gasket (26) except that the upstanding frame members (51, one not shown) projecting from the plane of the surface of the gasket are positioned around openings (52 one not shown) in the gasket (30) different in position from those in the gasket (26) around which frame members are positioned. The gasket (32) is of similar construction to gasket (28) except that in gasket (32) the channels (53, one not shown) in the walls of the gasket provide communicating channels between the central opening (54) and openings in the gasket (55, one not shown) different in position from those in the gasket 28 which are in communication with the central opening (45) in the gasket (28).

In the electrolytic cell, the gaskets (28) and (30) and the anode (29) together form an anode compartment of the cell; the compartment being bounded by the cation-exchange membranes (27, 31). Similarly, the cathode compartments of the cell, are formed by the cathode (25); gasket (26), and a gasket (not shown) of the type of (32) positioned adjacent to the cathode (25), the cathode compartment also being bounded by two cation-exchange membranes. In the assembled cell the cation-exchange membranes are held in position by gaskets positioned on either side of each membrane. For the sake of clarity, the embodiment of FIG. 5 does not show end plates for the cell which of course form a part of the cell, nor the means, e.g. bolts, which are provided in order to fasten together the electrodes and gaskets in a leak tight assembly. The cell comprises a plurality of anodes and cathodes as hereinbefore described. The cell also comprises headers (not shown) from which electrolyte may be charged to the compartment lengthwise of the cell of which the opening (37) in the cathode (25) forms a part. Similarly, the cell also comprises headers (not shown from which liquid, e.g. water, may be charged to the compartment lengthwise of the cell of which opening (36) in the cathode (25) forms a part and thence via a channel (not shown) in the wall of the gasket (32) to the cathode compartment of the cell, and to which products of electrolysis may be passed from the cathode compartments of the cell via a channel (53) in the wall of gasket (32) and via the compartment lengthwise of the cell of which the opening (35) in the cathode (25) forms a part.

In operation of the electrolytic cell, electrolyte is charged to the anode compartments of the cell, and a liquid is charged to the cathode compartments of the cell, and products of electrolysis are removed from the anode and cathode compartments of the cell.

Each of the anodes and cathodes comprises a pair of spaced apart barrier plates illustrated with reference to FIGS. 1 to 3, and in operation of the electrolytic cell, electrolyte is caused to rise by the gas lift effect in the space between the barrier plates 13 and the active electrode surface of the blades 4 and in the space between the barrier plate 14 and the active electrode surface of the blades 5. The electrolyte then passes downwardly from the top of the electrode compartment in the space between the barrier plates 13 and 14. There is thus continuous circulation of electrolyte in the electrode compartments resulting in very efficient mixing of electrolyte.

The invention is further illustrated by reference to the following Examples.

EXAMPLE 1

An aqueous solution of sodium chloride (200 g per liter) was electrolyzed in an electrolytic cell as described with reference to FIGS. 1 to 5 in which the anode 29 was provided with barrier plates 13, 14 made of a fluorinated ethylene-propylene copolymer, in which the cation-exchange membranes 27, 31 were of the perfluoro sulphonic acid type, and in which the blades of the anode 29 were coated with a solid solution of $RuO_2$ and $TiO_2$. The electrolyte was at a temperature of 87° C. and the electrolysis was effected at an anode current density of $3kA/m^2$.

During electrolysis 32% w/w aqueous sodium hydroxide solution was produced at a current efficiency of 94.5%.

In a Comparative Test, the electrolysis was carried out in an electrolytic cell not equipped with the barrier plates 13 and 14. A 32% w/w aqueous sodium hydroxide solution was produced at a current efficiency of 93%.

EXAMPLE 2

The process of Example 1 was repeated except that the cathode 25, as well as the anode 29, was fitted with barrier plates 13 and 14.

During electrolysis 32% w/w aqueous sodium hydroxide solution was produced at a current efficiency of 95.5%.

We claim:

1. An electrode comprising a first plate having an active electrode surface on a first face thereof and a second plate facing and spaced from the first plate, and at least one barrier plate which is a) positioned between said first and second plates, b) spaced from the active electrode surface of said first plate and from the facing surface of said second plate, and c) in contact with the opposite face of said first plate.

2. An electrode as claimed in claim 1 wherein two first plates are electrically connected to and spaced from each other, each having an outwardly facing active electrode surface, and wherein two barrier plates are disposed between the said first plates and are spaced from the said surfaces and from each other.

3. An electrode as claimed in claim 2 wherein at least one of the barrier plates is provided with spaced apart projections which contact a face of the other barrier plate.

4. An electrode as claimed in claim 1 wherein at least one of the barrier plates is made of a fluorine-containing organic fluoropolymeric material.

5. An electrode as claimed in claim 1 wherein the active electrode surface is provided by an electrocatalytically-active coating.

6. An electrode as claimed in claim 5 wherein, where the electrode is an anode, the electrocatalytically-active coating thereon is an admixture of an oxide of a platinum-group metal and a film-forming metal.

7. An electrode as claimed in claim 5 wherein, where the electrode is a cathode, the electrocatalytically-active coating thereon is a platinum group metal.

8. An electrolytic cell which comprises at least one anode and at least one cathode and a separator positioned between each anode and adjacent cathode, which divides the cell into separate anode and cathode compartments, or into a plurality of such compartments, and in which the anode or cathode or both comprise an electrode as claimed in claim 1 and wherein the separator is a hydraulically permeable diaphragm or an ion-exchange membrane.

9. An electrolytic cell as claimed in claim 8 in the form of a filter press configuration.

10. An electrolytic cell as claimed in claim 9 comprising a plurality of anodes and cathodes and gaskets of an electrically non-conducting material.

11. An electrolytic cell as claimed in claim 8 wherein the separator, where it is a hydraulically permeable diaphragm, is made of a fluorine-containing polymer.

12. An electrolytic cell as claimed in claim 8 wherein the separator, where it is an ion-exchange membrane, is made from a perfluoropolymeric material containing ionic groups.

13. A process for the electrolysis of an aqueous solution of an alkali metal chloride comprising the step of electrolyzing the said aqueous solution in an electrolytic cell as claimed in claim 8.

14. A process for the preparation of an electrode as claimed in claim 1 comprising the step of inserting one or more barrier plates into an existing electrode.

* * * * *